US009133403B2

(12) United States Patent
Mezza et al.

(10) Patent No.: US 9,133,403 B2
(45) **Date of Patent: *Sep. 15, 2015**

(54) HYDROCARBON CONVERSION PROCESS TO REMOVE METALS

(71) Applicant: UOP LLC, Des Plaines, IL (US)

(72) Inventors: Beckay J. Mezza, Arlington Heights, IL (US); Haiyan Wang, Hoffman Estates, IL (US); Christopher P. Nicholas, Evanston, IL (US); Alakananda Bhattacharyya, Glen Ellyn, IL (US); Brenna E. Huovie, Park Ridge, IL (US); Rajeswar R. Gattupalli, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 232 days.

This patent is subject to a terminal disclaimer.

(21) Appl. No.: 13/760,247

(22) Filed: Feb. 6, 2013

(65) Prior Publication Data

US 2014/0001092 A1 Jan. 2, 2014

Related U.S. Application Data

(60) Provisional application No. 61/665,935, filed on Jun. 29, 2012.

(51) Int. Cl.

| | |
|---|---|
| ***C10G 55/02*** | (2006.01) |
| ***C10G 55/04*** | (2006.01) |
| ***C10G 67/04*** | (2006.01) |
| ***C10G 21/18*** | (2006.01) |
| ***C10G 47/00*** | (2006.01) |

(52) U.S. Cl.

CPC ..... *C10G 67/04* (2013.01); *C10G 21/18* (2013.01); *C10G 47/00* (2013.01); *C10G 55/04* (2013.01); *C10G 2300/205* (2013.01); *C10G 2400/02* (2013.01); *C10G 2400/04* (2013.01); *C10G 2400/08* (2013.01)

(58) Field of Classification Search

CPC ..... C10G 55/04; C10G 67/04; C10G 21/24; C10G 55/06; C10G 21/28

USPC ..... 208/96, 237, 240, 251 R, 254 R, 209, 208/291

See application file for complete search history.

(56) References Cited

U.S. PATENT DOCUMENTS

| | | | | |
|---|---|---|---|---|
| 5,013,427 | A * | 5/1991 | Mosby et al. | 208/211 |
| 7,553,406 | B2 * | 6/2009 | Wasserscheid et al. | 208/236 |
| 2010/0243532 | A1 * | 9/2010 | Myers et al. | 208/254 R |
| 2011/0155637 | A1 | 6/2011 | Serban et al. | |
| 2011/0155638 | A1 | 6/2011 | Bhattacharyya et al. | |
| 2011/0155644 | A1 | 6/2011 | Bhattacharyya et al. | |

OTHER PUBLICATIONS

Parkash, S., Refining Processes Handbook, 2003, Gulf Publishing, pp. 176-209.*

U.S. Appl. No. 13/760,146, filed Feb. 6, 2013.

U.S. Appl. No. 13/760,292, filed Feb. 6, 2013.

U.S. Appl. No. 13/760,299, filed Feb. 6, 2013.

Search Report dated Dec. 19, 2013 for corresponding PCT application.

* cited by examiner

*Primary Examiner* — In Suk Bullock
*Assistant Examiner* — Derek Mueller

(57) ABSTRACT

The invention involves a process for hydrocarbon conversion. The process can include providing a feed to a primary upgrading zone and then treating the product from the primary upgrading zone with a feed-immiscible ionic liquid to remove metal compounds.

14 Claims, No Drawings

HYDROCARBON CONVERSION PROCESS TO REMOVE METALS

CROSS-REFERENCE TO RELATED APPLICATION

This application claims priority from Provisional Application No. 61/665,935 filed Jun. 29, 2012, the contents of which are hereby incorporated by reference.

FIELD OF THE INVENTION

This invention generally relates to a process for hydrocarbon conversion. More specifically, the invention relates to the use of ionic liquids to extract metal contaminants from intermediate products that are produced from heavy oils.

BACKGROUND OF THE INVENTION

As the reserves of conventional crude oils decline, heavy oils must be upgraded to meet demands for gasoline, diesel fuel, and other fuels. In upgrading these heavy oils, the heavier materials are converted to lighter fractions and most of the sulfur, nitrogen, carbon residue and metals must be removed. Crude oil is typically first processed in an atmospheric crude distillation tower to provide fuel products including naphtha, kerosene and diesel. The atmospheric crude distillation tower bottoms stream is typically taken to a vacuum distillation tower to obtain vacuum gas oil (VGO) that can be feedstock for an FCC unit or other uses. VGO typically boils in a range between at or about 300° C. (572° F.) and at or about 524° C. (975° F.).

Heavy oils include materials such as petroleum crude oil, atmospheric tower bottoms products, vacuum tower bottoms products, heavy cycle oils, shale oils, coal derived liquids, crude oil residuum, topped crude oils and the heavy bituminous oils extracted from oil sands which contain greater than 5 wt % material boiling at a temperature higher than 524° C. and preferably greater than 25 wt % material boiling at a temperature higher than 524° C. Of particular interest are the oils extracted from oil sands and which contain wide boiling range materials from naphthas through kerosene, gas oil, pitch, etc., and which contain a large portion, i.e. greater than 75%, of material boiling above 524° C. These heavy hydrocarbon feedstocks may be characterized by low reactivity in visbreaking, high coking tendency, poor susceptibility to hydrocracking and difficulties in distillation. Most residual oil feedstocks which are to be upgraded contain some level of asphaltenes which are typically understood to be heptane insoluble compounds as determined by ASTM D3279 or ASTM D6560. Asphaltenes are high molecular weight compounds containing heteroatoms which impart polarity.

Heavy oils are known to contain a variety of metal contaminants. The presence of metals in heavy oils during subsequent processing may cause environmental pollution, and may poison the catalysts used. The metals in the heavy oils tend to concentrate in the heavier hydrocarbon fractions, and these heavier fractions including resid and gas oils are normally treated to reduce the metal content. Metal contaminants may also be removed by adsorption onto solid particles such as catalysts or adsorbents. Such particles may be used in conjunction with hydrotreating processes that also reduce the metals content of the heavier hydrocarbon fractions.

Heavy oils must be upgraded in a primary upgrading unit before it can be further processed into usable products. Primary upgrading units known in the art include, but are not restricted to, coking processes, such as delayed or fluidized coking, and hydrogen addition processes such as ebullated bed or slurry hydrocracking (SHC). As an example, the yield of liquid products, at room temperature, from the coking of some Canadian bitumens is typically about 55 to 60 wt % with substantial amounts of coke as by-product. On similar feeds, ebullated bed hydrocracking typically produces liquid yields of 50 to 55 wt %. U.S. Pat. No. 5,755,955 describes a SHC process which has been found to provide liquid yields of 75 to 80 wt % with much reduced coke formation through the use of additives. Slurry hydrocracking (SHC), one such primary upgrading process, is used for the primary upgrading of heavy hydrocarbon feedstocks obtained from the distillation of crude oil, including hydrocarbon residues or gas oils from atmospheric column or vacuum column distillation. In SHC, these liquid feedstocks are mixed with hydrogen and solid catalyst particles, e.g., as a particulate metallic compound such as a metal sulfide, to provide a slurry phase. Representative SHC processes are described, for example, in U.S. Pat. No. 5,755,955 and U.S. Pat. No. 5,474,977. SHC produces naphtha, diesel, gas oil such as VGO, and a low-value, refractory pitch stream. The VGO streams are typically further refined in catalytic hydrocracking or fluid catalytic cracking (FCC) to provide saleable products. To prevent excessive coking in the SHC reactor, heavy VGO (HVGO) can be recycled to the SHC reactor.

The naphtha, diesel oil and vacuum gas oils that are produced by SHC or other primary upgrading processes are some of the intermediate products that require further processing. They have impurities that include high nitrogen (compounds), metal, carbon residue and sulfur (including sulfur compounds) levels. Organo-metallic compounds, in particular, are difficult to remove by hydrotreating and metals tend to accumulate on catalyst particles where they act as a catalyst poison. It has now been found that treatment with certain ionic liquids can reduce the level of metal compounds by from a small amount just above 0% and up to 100% depending upon the ionic liquid used and the number of ionic liquid treatments that are done. Carbon residue, sulfur and nitrogen can also be reduced. Following the removal of these impurities, the intermediate products can undergo downstream processing such as hydroprocessing, hydrocracking, fluid catalytic cracking (FCC), blending, platforming and other processes as known to one skilled in the art.

SUMMARY OF THE INVENTION

The invention involves a process for hydrocarbon conversion. The process can include providing a heavy oil feed to a primary upgrading zone such as a slurry hydrocracking zone, and obtaining a hydrocarbon stream, including one or more $C_{16}$-$C_{45}$ hydrocarbons, from at least one separator. The hydrocarbon stream may be a light or heavy vacuum gas oil, a diesel oil, naphtha or other hydrocarbon. This hydrocarbon stream is then sent to an extraction apparatus to contact the feed with an ionic liquid to remove metal compounds. The hydrocarbon stream that has been treated with the ionic liquid may then be further treated, depending upon the composition of the hydrocarbon stream and depending upon the desired product. In some embodiments of the invention, there will be multiple steps in which the hydrocarbon stream is sent to an extraction apparatus to contact the feed with an ionic liquid to remove metal compounds. In some instances, the heavy oil feed may be treated prior to primary upgrading. In some embodiments, the hydrocarbon feed will be treated with an ionic liquid to remove metal compounds, then sent to a processing unit for further treatment and then a feed may be returned to be treated again with an ionic liquid to further reduce the level of metal compounds to a desired level. The processing that is used to provide further treatment may include hydroprocessing, hydrocracking, fluid catalytic cracking (FCC), blending, platforming and other processes as known to one skilled in the art.

In an embodiment, the invention is a process for removing a metal compound from a hydrocarbon stream which may be a vacuum resid, a light or heavy vacuum gas oil, a diesel oil, naphtha or other hydrocarbon comprising: contacting the hydrocarbon stream comprising the metal compound with a hydrocarbon-immiscible ionic liquid comprising at least one of an imidazolium ionic liquid, an ammonium ionic liquid, a pyridinium ionic liquid, and a phosphonium ionic liquid to produce a mixture comprising the hydrocarbon stream and the hydrocarbon stream-immiscible ionic liquid; separating the mixture to produce a hydrocarbon stream effluent and a hydrocarbon stream-immiscible ionic liquid effluent comprising the metal compounds. Imidazolium, pyridinium, and ammonium ionic liquids have a cation comprising at least one nitrogen atom. In another embodiment, the hydrocarbon stream-immiscible ionic liquid comprises at least one of 1-ethyl-3-methylimidazolium ethyl sulfate, 1-butyl-3-methylimidazolium hydrogen sulfate, 1-ethyl-3-methylimidazolium chloride, 1-ethyl-3-methylimidazolium bis(trifluoromethylsulfonyl)imide, 1-butyl-3-methylimidazolium hexafluorophosphate, 1-butyl-3-methylimidazolium tetrafluoroborate, tetraethyl-ammonium acetate, tetrabutyl phosphonium methane sulfonate, and 1-butyl-4-methypyridinium hexafluorophosphate.

In another embodiment, the ionic liquid comprises at least one ionic liquid from at least one of the following ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides. In another embodiment, the feed-immiscible phosphonium ionic liquid comprises at least one of trihexyl(tetradecyl)phosphonium chloride, trihexyl (tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl (methyl)phosphonium methylsulfate, tributyl(ethyl) phosphonium diethylphosphate, and tetrabutylphosphonium methanesulfonate The hydrocarbon streams that are treated in accordance with the present invention may also be treated by the same or other hydrocarbon stream-immiscible ionic liquids to remove other impurities such as metals, carbon residue and sulfur compounds.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, sulfur, carbon residue and nitrogen compounds. A stream can also include aromatic and non-aromatic hydrocarbons, or other gases absent hydrocarbons, such as hydrogen. Moreover, the hydrocarbon molecules may be abbreviated $C_1$, $C_2$, $C_3$ . . . $C_n$ where "n" represents the number of carbon atoms in the one or more hydrocarbon molecules. Furthermore, a superscript "+" or "−" may be used with an abbreviated one or more hydrocarbons notation, e.g., $C^{3+}$ or $C^{3-}$, which is inclusive of the abbreviated one or more hydrocarbons. As an example, the abbreviation "$C^{3+}$" means one or more hydrocarbon molecules of three carbon atoms and/or more.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "megapascal" may be abbreviated "MPa".

As used herein, the term "liquid hourly space velocity" may be abbreviated "LHSV".

As used herein, the term "overhead stream" can mean a stream withdrawn at or near a top of a vessel, typically a distillation column or flash drum.

As used herein, the term "bottom stream" can mean a stream withdrawn at or near a bottom of a vessel, typically a distillation column or flash drum.

As used herein, "pitch" means the hydrocarbon material boiling above about 524° C. (975° F.) AEBP as determined by any standard gas chromatographic simulated distillation method such as ASTM D2887, D6352 or D7169, all of which are used by the petroleum industry.

As used herein, "pitch conversion" means the conversion of materials boiling above 524° C. (975° F.) in which they are converted to materials boiling at or below 524° C. (975° F.).

As used herein, "diesel" means the hydrocarbon material boiling in the range between about 178° C. (353° F.) and about 355° C. (672° F.) atmospheric equivalent boiling point (AEBP) as determined by any standard gas chromatographic simulated distillation method such as ASTM D2887, all of which are used by the petroleum industry. The hydrocarbon material may be more contaminated and contain a greater amount of aromatic compounds than is typically found in refinery products.

As used herein, "vacuum gas oil" means the hydrocarbon material boiling in the range between about 300° C. (572° F.) and about 524° C. (975° F.) AEBP as determined by any standard gas chromatographic simulated distillation method such as ASTM D2887, all of which are used by the petroleum industry. The hydrocarbon material may be more contaminated and contain a greater amount of aromatic compounds than is typically found in refinery products.

As used herein, "heavy vacuum gas oil" means the hydrocarbon material boiling in the range between about 427° C. (800° F.) and about 524° C. (975° F.) AEBP as determined by any standard gas chromatographic simulated distillation method such as ASTM D2887, D6352 or D7169, all of which are used by the petroleum industry. The hydrocarbon material may be more contaminated and contain a greater amount of aromatic compounds than is typically found in refinery products.

As used herein, "naphtha" means the hydrocarbon material boiling in the range between about 30° C. (86° F.) and about 200° C. (392° F.) atmospheric equivalent boiling point (AEBP) as determined by any standard gas chromatographic simulated distillation method such as ASTM D2887, all of which are used by the petroleum industry. The hydrocarbon material may be more contaminated and contain a greater amount of aromatic compounds than is typically found in refinery products.

As used herein, "vacuum resid" means the hydrocarbon material boiling in the range containing about 90% of material boiling above 524° C. (975° F.) as determined by any standard gas chromatographic simulated distillation method such as ASTM D2887, D6352 or D7169, all of which are used by the petroleum industry. The terms vacuum resid and pitch are sometimes used interchangeably. The hydrocarbon material may be more contaminated and contain a greater amount of aromatic compounds than is typically found in refinery products.

As used herein "heavy oil" means materials such as petroleum crude oil, atmospheric tower bottoms products, vacuum tower bottoms products, heavy cycle oils, shale oils, coal derived liquids, crude oil residuum, topped crude oils and the heavy bituminous oils extracted from oil sands which contain greater than 5 wt % material boiling at a temperature higher than 524° C. and preferably greater than 25 wt % material boiling at a temperature higher than 524° C.

As used herein, "contaminant" means species found in the hydrocarbon material that is detrimental to further processing. Contaminants include nitrogen, sulfur, metals (specifically nickel and vanadium) and Conradson carbon residue or carbon residue.

DETAILED DESCRIPTION

Embodiments of the invention relate to reacting of a heavy hydrocarbon feedstock for primary upgrading into fuel. According to one embodiment, for example, the heavy hydrocarbon feedstock comprises a vacuum column residue (vacuum resid). Representative further components of the heavy hydrocarbon feedstock include residual oils boiling above 524° C. (975° F.), tars, bitumen, coal oils, and shale oils. Other asphaltene-containing materials may also be used as components processed by SHC or other primary upgrading processes. In addition to asphaltenes, these further possible components of the heavy hydrocarbon feedstock, among other attributes, generally also contain significant metallic contaminants, e.g., nickel, iron and vanadium, a high content of organic sulfur and nitrogen compounds, and a high Conradson carbon residue. The metals content of such components, for example, may be in the range of 100 ppm to 1,000 ppm by weight, the total sulfur content may range from 1 to 7 wt %, and the API gravity may range from about −5° to about 35°. The Conradson carbon residue of such components is generally at least about 5 wt %, and is often from about 10 to about 30 wt %.

The primary upgrading process may include slurry hydrocracking, vis-breaking, delayed coking and other non-catalytic and catalytic processes as are known to one skilled in the art. Typical vis-breaking and delayed coking processes are described in Chapters 12.1-12.3 in Robert A. Meyers, ed. Handbook of Petroleum Refining Processes, Third Edition, McGraw-Hill 2003.

Due to the heavy nature of bitumen feeds and residual oils, the product derived from the primary upgrading process contains not only a large amount of metal, carbon residue, nitrogen and sulfur which must be hydrotreated out of the product, but the metals are very difficult to remove. This makes it important to remove these impurities in order to be able to make the utilization of the product from the primary upgrading process economically advantageous. LVGO (light vacuum gas oil), HVGO and diesel range products from the primary upgrading process contain high levels of metal, carbon residue, nitrogen and sulfur and they are very difficult to hydrotreat because of high aromaticity. It has been found that metal contaminants can deposit on catalyst particles and block the active sites on the catalyst. Some metals can deposit on the catalyst surface where they promote coke formation and increase the light gas yield. Ionic liquids, on the other hand, have been found to selectively extract the detrimental metal compounds. Bench scale lab experiments demonstrate greater than 60% metal compound extraction efficiency from slurry hydrotreating processes using ionic liquids. Higher levels of metal compound extraction up to 100% extraction efficiency can be achieved by multiple treatments with ionic liquids. The level of metal compound extraction depends upon the nature of the impurities found and the economics of the process.

In the process of the invention, there may be a combination of apparatus such as a compressor, a slurry hydrocracking zone, a hydrocracking zone, a hydrotreating zone, a separation zone and an ionic liquid treatment zone. Other thermal conversion zones may be found as well. There may also be a naphtha hydrotreatment zone, an FCC zone or an isomerization one. An exemplary naphtha hydrotreatment zone is disclosed in, e.g., U.S. Pat. No. 7,727,490 and an exemplary isomerization zone is disclosed in, e.g., U.S. Pat. No. 7,223,898. Often, the apparatus can be any suitable refinery or chemical manufacturing facility.

Exemplary zones that may be used in the process of the invention are disclosed in, e.g., U.S. Pat. No. 5,755,955; U.S. Pat. No. 5,474,977; US 2009/0127161; US 2010/0248946; US 2011/0306490; and US 2011/0303580 which are incorporated herein by reference in their entireties.

The present invention involves the use of ionic liquid extraction as a step and often an intermediate step in the process. Since the feed being treated can be significantly different depending upon the source of the heavy oil or heavy hydrocarbon that is the starting point, there are some situations where it would be advantageous to have an ionic liquid extraction step prior to thermal treatment and separation. In other instances the ionic liquid extraction step will follow thermal treatment but be prior to separation into fractions by distillation or other separation process. In yet another embodiment of the invention, the vacuum resid, VGO fractions or the diesel fraction from the primary upgrading process is extracted with ionic liquids to remove metal, carbon residue, nitrogen and sulfur compounds.

The present invention is a process for removing metal compounds from a vacuum resid, vacuum gas oil, diesel fuel or other feed derived from a primary upgrading process comprising contacting the feed with a feed-immiscible ionic liquid to produce a processed product and feed-immiscible ionic liquid mixture, and separating the mixture to produce a processed effluent and a feed-immiscible ionic liquid effluent comprising the metal compounds.

The processed effluent is subjected to further processing before or after the contact with the hydrocarbon feed-immiscible ionic liquid or between two periods of contact with the hydrocarbon feed-immiscible ionic liquid.

The ionic liquid comprises at least one ionic liquid from at least one of the following ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides. In another embodiment, the hydrocarbon feed-immiscible ionic liquid comprises at least one of trihexyl(tetradecyl) phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl) phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate.

There are numerous embodiments of the invention in which a process of treating hydrocarbons involves combinations of ionic liquid extraction and further treatment. The following are representative combinations of ionic liquid extraction and further treatment.

In some instances the hydrocarbons are treated by ionic liquids and the treated material is a finished product that may be used for its intended use. In other instances, the hydrocarbons are treated by ionic liquids and then undergo further treatment in one or more downstream reactors, such as a hydrotreater or hydroprocessing unit or in an FCC unit. An additional ionic liquid treatment step may take place to further remove impurities.

Other configurations may be employed as well, such as multiple hydrotreating and other downstream treatment steps and multiple ionic liquid extraction steps in order to produce a product stream with the desired level of purity.

The term "downstream processing" as referred to herein includes hydrocracking, hydrotreating, platforming, fluidized catalytic cracking and other hydrocarbon upgrading processes that are known to those skilled in the art. Hydrocracking refers to a process in which hydrocarbons crack in the presence of hydrogen to lower molecular weight hydrocarbons. Hydrocracking also includes slurry hydrocracking in which resid feed is mixed with catalyst and hydrogen to make a slurry and cracked to lower boiling products. VGO in the products may be recycled to manage coke precursors referred to as mesophase. Naphtha feeds may be sent to a platformer for further treatment or may first be sent to a naphtha hydrotreater before being sent to a platformer. Fluidized catalytic cracking (FCC) may be used to produce gasoline. VGO feeds may be sent to an FCC unit for use in gasoline or to a hydrocracker in the production of distillate. A diesel feed may be further treated in a hydrotreater and undergo further processing in the production of ultra-low sulfur diesel fuel. Hydrotreating is a process wherein hydrogen is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. However, it has been found that hydrotreating is ineffective in removal of certain refractory heteroatoms.

In general, products from the primary upgrading process comprise petroleum hydrocarbon components boiling in the range of from about 100° to about 720° C. In an embodiment, the product from the primary upgrading process boils from about 250° to about 650° C. and has a density in the range of from about 0.87 to about 0.95 g/cm$^3$. In another embodiment, the product from the primary upgrading process boils from about 95° to about 580° C.; and in a further embodiment, the product from the primary upgrading process boils from about 300° to about 720° C. Generally, product from slurry hydrocracking may contain from about 0.1 to about 6000 ppm-wt metal. In an embodiment, the metal content of the product from the primary upgrading process ranges from about 0.1 to about 2000 ppm-wt. The metal content may be determined using UOP method 389-10, Trace metals in organics by Inductively Coupled Plasma—Optical Emission Spectrometry (ICP OES). Similar products that are derived from other primary upgrading processes may also be treated by ionic liquids in accordance with the present invention.

Processes according to the invention remove metal compounds from products from primary upgrading. It is understood that product from primary upgrading will usually comprise a plurality of metal compounds of different types in various amounts. Thus, the invention removes at least a portion of at least one type of metal compound from the product from slurry hydrocracking and other primary upgrading processes. The invention may remove the same or different amounts of each type of metal compound, and some types of metal compounds may not be removed. The metal content of the product from primary upgrading is reduced by at least 5 wt % in some instances and at least 10 wt % in others. The metal content may be reduced by 40 wt %. In other instances, the metal content of the product from primary upgrading is reduced by at least 80 wt % and it may be reduced by at least 90 wt % and even up to 100 wt %. The amount of reduction of the metal content will depend upon the particular metal compounds found in the hydrocarbon feed as well as economics.

One or more ionic liquids are used to extract one or more metal compounds from product from primary upgrading. Generally, ionic liquids are non-aqueous, organic salts composed of ions where the positive ion is charge balanced with negative ion. These materials have low melting points, often below 100° C., undetectable vapor pressure and good chemical and thermal stability. The cationic charge of the salt is localized over hetero atoms such as nitrogen, phosphorous, sulfur, arsenic, boron, antimony, and aluminum, and the anions may be any inorganic, organic, or organometallic species.

Ionic liquids suitable for use in the instant invention include ionic liquids that are immiscible in the hydrocarbon feed to be treated. As used herein the term "hydrocarbon feed-immiscible ionic liquid" means an ionic liquid which is capable of forming a separate phase from the hydrocarbon feed under operating conditions of the process. Ionic liquids that are miscible with the feed at the process conditions will be completely soluble with the product from primary upgrading; therefore, no phase separation will be feasible. Thus, hydrocarbon feed-immiscible ionic liquids may be insoluble with or partially soluble with feed under operating conditions. A ionic liquid capable of forming a separate phase from the product from primary upgrading under the operating conditions is considered to be feed-immiscible. Ionic liquids according to the invention may be insoluble, partially soluble, or completely soluble (miscible) with water.

The hydrocarbon feed-immiscible ionic liquid comprises at least one ionic liquid from at least one of the following groups of ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halide. More specifically, the hydrocarbon feed-immiscible ionic liquid comprises at least one of trihexyl(tetradecyl)phosphonium chloride, trihexyl(tetradecyl)phosphonium bromide, tributyl (methyl)phosphonium bromide, tributyl(methyl)phosphonium chloride, tributyl(hexyl)phosphonium bromide, tributyl (hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl) phosphonium diethylphosphate, and tetrabutylphosphonium methanesulfonate. In a further embodiment, the hydrocarbon feed-immiscible ionic liquid is selected from the group consisting of trihexyl(tetradecyl)phosphonium chloride, trihexyl (tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl (methyl)phosphonium methylsulfate, tributyl(ethyl) phosphonium diethylphosphate, tetrabutylphosphonium methanesulfonate, and combinations thereof. The hydrocarbon feed-immiscible ionic liquid may be selected from the group consisting of trihexyl(tetradecyl)phosphonium halides, tetraalkylphosphonium dialkylphosphates, tetraalkylphosphonium tosylates, tetraalkylphosphonium sulfonates, tetraalkylphosphonium halides, and combinations thereof. The hydrocarbon feed-immiscible ionic liquid may comprise at least one ionic liquid from at least one of the following groups of ionic liquids trihexyl(tetradecyl)phosphonium halides, tetraalkylphosphonium dialkylphosphates, tetraalkylphosphonium tosylates, tetraalkylphosphonium sulfonates, and tetraalkylphosphonium halides.

In an embodiment, the invention is a process for removing metal compounds from feeds such as vacuum resid, light and heavy vacuum gas oil (VGO), diesel fuel or naphtha that are derived from primary upgrading processes such as slurry hydrocracking in which the process comprises a contacting step and a separating step. In the contacting step, the feed comprising a metal compound and other contaminants and a hydrocarbon feed-immiscible ionic liquid are contacted or mixed. The contacting may facilitate transfer or extraction of the one or more metal compounds from the feed to the ionic liquid. Although a hydrocarbon feed-immiscible ionic liquid that is partially soluble in the feed may facilitate transfer of the metal compound from the feed to the ionic liquid, partial solubility is not required. Insoluble feed/ionic liquid mixtures may have sufficient interfacial surface area between the feed and ionic liquid to be useful. In the separation step, the mixture of the feed and ionic liquid settles or forms two phases, a feed phase and an ionic liquid phase, which is separated to produce a hydrocarbon feed-immiscible ionic liquid effluent and a feed effluent.

The process may be conducted in equipment which are well known in the art and are suitable for batch or continuous operation. For example, various mixers or vessels may employed. The mixing or agitation is stopped and the mixture forms a feed phase and an ionic liquid phase which can be separated, for example, by decanting, centrifugation, or other means to produce an effluent having lower metal compound content relative to the product from primary upgrading. The process also produces a hydrocarbon feed-immiscible ionic liquid effluent comprising the one or more metal compounds.

The contacting and separating steps may be repeated, for example, when the metal content of the effluent is to be reduced further to obtain a desired metal level in the ultimate product stream from the process. Each set, group, or pair of contacting and separating steps may be referred to as a metal compound removal step. Thus, the invention encompasses single and multiple metal removal steps. A contaminant removal zone may be used to perform a metal compound and other contaminant removal step. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The metal compound and contaminant removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

In an embodiment of the invention a contaminant is removed in an extraction zone that comprises a multi-stage, counter-current extraction column wherein the feed and hydrocarbon feed-immiscible ionic liquid are contacted and separated. Consistent with common terms of art, the ionic liquid introduced to the contaminant removal step may be referred to as a "lean ionic liquid" generally meaning a hydrocarbon feed-immiscible ionic liquid that is not saturated with one or more extracted contaminant. Lean ionic liquid may include one or both of fresh and regenerated ionic liquid and is suitable for accepting or extracting contaminant removal compounds from the feed. Likewise, the ionic liquid effluent may be referred to as "rich ionic liquid", which generally means a hydrocarbon feed-immiscible ionic liquid effluent produced by a contaminant removal step or process or otherwise including a greater amount of extracted contaminant removal compounds than the amount of extracted contaminant removal included in the lean ionic liquid. A rich ionic liquid may require regeneration or dilution, e.g. with fresh ionic liquid, before recycling the rich ionic liquid to the same or another contaminant removal step of the process.

The impurity or contaminant removal step may be conducted under conditions including temperatures and pressures sufficient to keep the hydrocarbon feed-immiscible ionic liquid and feeds and effluents as liquids. For example, the contaminant removal step temperature may range between about 10° C. and less than the decomposition temperature of the ionic liquid; and the pressure may range between about atmospheric pressure and about 700 kPa(g). When the feed-immiscible ionic liquid comprises more than one ionic liquid component, the decomposition temperature of the ionic liquid is the lowest temperature at which any of the ionic liquid components decompose. The contaminant removal step may be conducted at a uniform temperature and pressure or the contacting and separating steps of the contaminant removal step may be operated at different temperatures and/or pressures. In an embodiment, the contacting step is conducted at a first temperature, and the separating step is conducted at a temperature at least 5° C. lower than the first temperature. In a non limiting example, the first temperature is about 80° C. Such temperature differences may facilitate separation of the feed and ionic liquid phases.

The above and other contaminant removal step conditions such as the contacting or mixing time, the separation or settling time, and the ratio of feed to feed-immiscible ionic liquid (lean ionic liquid) may vary greatly based, for example, on the specific ionic liquid or liquids employed, the nature of the feed, the metal content of the feed, the degree of contaminant removal required, the number of steps employed, and the specific equipment used. In general it is expected that contacting time may range from less than one minute to about two hours; settling time may range from about one minute to about eight hours; and the weight ratio of feed to lean ionic liquid introduced to the contaminant removal step may range from 1:10,000 to 10,000:1. In an embodiment, the weight ratio of feed to lean ionic liquid may range from about 1:1,000 to about 1,000:1; and the weight ratio of feed to lean ionic liquid may range from about 1:100 to about 100:1. In an embodiment the weight of feed is greater than the weight of ionic liquid introduced to the contaminant removal step.

In an embodiment, a single metal removal step reduces the metal compound content of the feed by more than about 5 wt %, in other instances more than about 10 wt % or up to 40 wt %. In another embodiment, more than about 50% of the metal compounds by weight is extracted or removed from the feed in a single metal compound removal step; and more than about 60% of the metal by weight may be extracted or removed from the feed in a single contaminant removal step. Greater amounts of the metal compounds may be removed and in some instances as much as 90 to 100 wt % may be removed in a single contaminant removal step. As discussed herein the invention may encompass multiple contaminant removal steps to provide the desired amount of contaminant removal which can be up to 100% removal of the metal compounds. The degree of phase separation between the feed and ionic liquid phases is another factor to consider as it affects recovery of the ionic liquid and feed. The degree of contaminant removed and the recovery of the feed and ionic liquids may be affected differently by the nature of the feed, the specific ionic liquid or liquids, the equipment, and the contaminant removal conditions such as those discussed above.

In order to regenerate the ionic liquid, the feed and hydrocarbon feed-immiscible ionic liquid effluent is mixed with water or a water soluble light hydrocarbon, or a mixture of water and water soluble light hydrocarbon, any of which might act as an ionic liquid regeneration solvent. The metal containing hydrocarbon phase then separates from the solvent containing ionic liquid phase to produce an extract stream. The solvent is then boiled away from the ionic liquid leaving behind regenerated ionic liquid. In a second embodiment to regenerate the ionic liquid, the feed and hydrocarbon feed-immiscible ionic liquid effluent is mixed with water or a water insoluble light hydrocarbon, or a mixture of water and water insoluble light hydrocarbon, any of which might act as an ionic liquid regeneration solvent. The metal containing hydrocarbon phase and water insoluble light hydrocarbon then separate from the potentially water containing ionic liquid phase to yield an extract stream. The water insoluble light hydrocarbon can be boiled away from the metal containing hydrocarbon phase and recycled to the first step of the regeneration process. The potential water can then be boiled away from the ionic liquid leaving behind regenerated ionic liquid.

The amount of water present in the hydrocarbon feed/hydrocarbon feed-immiscible ionic liquid mixture during the contaminant removal step may also affect the amount of contaminant removed and/or the degree of phase separation, i.e., recovery of the feed and ionic liquid. In an embodiment, the hydrocarbon feed/hydrocarbon feed-immiscible ionic liquid mixture has a water content of less than about 10% relative to the weight of the ionic liquid. In another embodiment, the water content of the hydrocarbon feed/hydrocarbon feed-immiscible ionic liquid mixture is less than about 5% relative to the weight of the ionic liquid; and the water content of the hydrocarbon feed/hydrocarbon feed-immiscible ionic liquid mixture may be less than about 2% relative to the weight of the ionic liquid. In a further embodiment, the hydrocarbon feed/hydrocarbon feed-immiscible ionic liquid mixture is water free, i.e., the mixture does not contain water.

Unless otherwise stated, the exact connection point of various inlet and effluent streams within the zones is not essential to the invention. For example, it is well known in the art that a stream to a distillation zone may be sent directly to the column, or the stream may first be sent to other equipment within the zone such as heat exchangers, to adjust temperature, and/or pumps to adjust the pressure. Likewise, streams entering and leaving contaminant removal, washing, and regeneration zones may pass through ancillary equipment such as heat exchanges within the zones. Streams, including recycle streams, introduced to washing or extraction zones may be introduced individually or combined prior to or within such zones.

The invention encompasses a variety of flow scheme embodiments including optional destinations of streams, splitting streams to send the same composition, i.e. aliquot portions, to more than one destination, and recycling various streams within the process. Examples include: various streams comprising ionic liquid and water may be dried and/or passed to other zones to provide all or a portion of the water and/or ionic liquid required by the destination zone. The various process steps may be operated continuously and/or intermittently as needed for a given embodiment e.g. based on the quantities and properties of the streams to be processed in such steps. As discussed above the invention encompasses multiple contaminant removal steps, which may be performed in parallel, sequentially, or a combination thereof. Multiple contaminant removal steps may be performed within the same contaminant removal zone and/or multiple contaminant removal zones may be employed with or without intervening washing, regeneration and/or drying zones.

Other configurations may be employed as well, such as multiple primary upgrading or other process steps and multiple ionic liquid extraction steps in order to produce a product stream with the desired level of purity.

EXAMPLES

The examples are presented to further illustrate some aspects and benefits of the invention and are not to be considered as limiting the scope of the invention.

A digital hot plate magnetic stirrer was used to screen ionic liquids for de-contamination of thermal cracking products. The experiments were conducted in 6 dram vials with 19 mm (0.75 inch) cross shaped magnetic stir bars for mixing or in 250 ml beakers. For the purposes of the screening study, 3 grams of ionic liquid were combined in a vial with 6 grams of hydrocarbon product from thermal cracking of vacuum resid, then heated to 80° C. and mixed at 300 rpm for 30 minutes. After 30 minutes, the mixing was stopped and the samples were held static at 80° C. In successful experiments separation occurred and the extracted product was suctioned off with a glass pipette.

Example 1

A boiling range as indicated of a hydrocarbon product from the thermal cracking of vacuum resid with the following properties was used in this example.

The boiling point range was determined by ASTM method D2887 and is shown in Table 1.

TABLE 1

| | Temp ° C. |
|---|---|
| IBP | 122 |
| 5% | 181 |
| 25% | 244 |
| 50% | 292 |
| 75% | 337 |
| 95% | 374 |
| FBP | 392 |

Other analysis are shown in Table 2.

TABLE 2

| Feed Analysis | |
|---|---|
| Nitrogen by chemiluminescence, ppm | 3326 |
| Sulfur by XRF, wt % | 1.21 |
| Nickel by ICP, ppm | <0.03 |
| Vanadium by ICP, ppm | <0.03 |

A sample of ionic liquid (triisobutyl(methyl)phosphonium tosylate) was used. 3 g triisobutyl(methyl)phosphonium tosylate and 6 g of hydrocarbon were combined in a 22 ml vial with a stir bar. The vial was placed onto a heated stir plate and stirred at 80° C. for 30 minutes. After 30 minutes, the stirring was stopped and the ionic liquid mixture was allowed to settle for 30 minutes. The material was then separated from the ionic liquid and analyzed for N content. The denitrogenated material was found to contain 577 ppm N.

Example 2

A sample of ionic liquid (tributyl(ethyl)phosphonium diethylphosphate) was used. The procedure of Example 1 was followed, substituting tributyl(ethyl)phosphonium diethylphosphate for triisobutyl(methyl)phosphonium tosylate. The denitrogenated material was found to contain 939 ppm N.

Example 3

A sample of ionic liquid (tributyl(octyl)phosphonium chloride) was used. The procedure of Example 1 was followed, substituting tributyl(octyl)phosphonium chloride for triisobutyl(methyl)phosphonium tosylate. The denitrogenated material was found to contain 311 ppm N.

Example 4

A sample of ionic liquid (tributyl(ethyl)phosphonium diethylphosphate) was used. Tributyl(ethyl)phosphonium diethylphosphate and the product described in Table 1 and 2 were combined in a beaker at ratio of 10:1 product: ionic liquid The beaker was placed onto a heated stir plate and stirred at 80° C. for 30 minutes. After 30 minutes, the stirring was stopped and the ionic liquid/mixture was allowed to settle for 30 minutes. The material was then separated from the ionic liquid and analyzed for nitrogen, sulfur and nickel plus vanadium content. The decontaminated material was found to contain 1670 ppm N, 1.19 wt % sulfur and less than 0.05 ppm nickel plus vanadium.

Example 5

A hydrocarbon product from thermal cracking of vacuum resid with the following properties was used in this example The boiling point range of the hydrocarbon product was determined by ASTM method D2887 and is shown in Table 3.

TABLE 3

| | Temp ° C. |
|---|---|
| IBP | 296 |
| 5% | 318 |
| 25% | 347 |
| 50% | 377 |
| 75% | 408 |
| 95% | 447 |
| FBP | 537 |

Other analysis of the hydrocarbon product are shown in Table 4.

TABLE 4

| Feed Analysis | |
|---|---|
| Nitrogen by chemiluminescence, ppm | 6172 |
| Sulfur by XRF, wt % | 1.44 |
| Carbon Residue | 0.08 |
| Nickel by ICP, ppm | 0.11 |
| Vanadium by ICP, ppm | <0.06 |

A sample of ionic liquid (triisobutyl(methyl)phosphonium tosylate) was used. 3 g triisobutyl(methyl)phosphonium tosylate and 6 g thermal cracking product were combined in a 6 dram vial with a stir bar. The vial was placed onto a heated stir plate and stirred at 80° C. for 30 minutes. After 30 minutes, the stirring was stopped and the ionic liquid mixture was allowed to settle for 30 minutes. The material was then separated from the ionic liquid and analyzed for N content. The denitrogenated material was found to contain 1505 ppm N.

Example 6

A sample of ionic liquid (tributyl(ethyl)phosphonium diethylphosphate) was used. The procedure of Example 5 was followed, substituting tributyl(ethyl)phosphonium diethylphosphate for triisobutyl(methyl)phosphonium tosylate. The denitrogenated material was found to contain 1676 ppm N.

Example 7

A sample of ionic liquid (tributyl(octyl)phosphonium chloride) was used. The procedure of Example 5 was followed, substituting tributyl(octyl)phosphonium chloride for triisobutyl(methyl)phosphonium tosylate. The denitrogenated material was found to contain 619 ppm N.

Example 8

A hydrocarbon product from slurry hydrocracking of vacuum resid with the following properties was used in this example.

The boiling point range of the hydrocarbon product was determined by ASTM method D2887 and is shown in Table 5.

TABLE 5

| | Temp ° C. |
|---|---|
| IBP | 328.2 |
| 5% | 363.4 |
| 25% | 384 |

TABLE 5-continued

| | Temp ° C. |
|---|---|
| 50% | 399.4 |
| 75% | 415.2 |
| 95% | 439 |
| FBP | 588.2 |

Other analysis of the hydrocarbon product is shown in Table 6.

TABLE 6

| Feed Analysis | |
|---|---|
| Nitrogen by chemiluminescence, ppm | 7000 |
| Carbon Residue, wt % | 0.175 |
| Nickel + Vanadium by ICP, ppm | 0.2 |

A sample of ionic liquid (triisobutyl(methyl)phosphonium tosylate) was used. Triisobutyl(methyl)phosphonium tosylate and the product described in table 3 and 4 were combined in a beaker at ratio of 10:1 product: ionic liquid. The beaker was placed onto a heated stir plate and stirred at 80° C. for 30 minutes. After 30 minutes, the stirring was stopped and the ionic liquid mixture was allowed to settle for 30 minutes. The material was then separated from the ionic liquid and analyzed for nitrogen, carbon residue and nickel plus vanadium content. The decontaminated material was found to contain 3735 ppm N, 0.07 wt % carbon residue and 0.05 ppm nickel plus vanadium.

Example 9

A sample of ionic liquid (triisobutyl(methyl)phosphonium tosylate) was used. Triisobutyl(methyl)phosphonium tosylate and product described in table 3 and 4 were combined in a beaker at ratio of 2:1 product: ionic liquid The beaker was placed onto a heated stir plate and stirred at 80° C. for 30 minutes. After 30 minutes, the stirring was stopped and the ionic liquid mixture was allowed to settle for 30 minutes. The material was then separated from the ionic liquid and analyzed for nitrogen, carbon residue and nickel plus vanadium content. The decontaminated material was found to contain 1780 ppm N, 0.035 wt % carbon residue and less than 0.05 ppm nickel plus vanadium.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for hydrocarbon conversion, comprising:

(a) providing a heavy oil hydrocarbon feed to a primary upgrading zone, wherein the primary upgrading zone comprises:

(1) at least one upgrading reactor; and (2) at least one separator;

(b) obtaining a hydrocarbon stream comprising one or more $C_{16}$-$C_{45}$ hydrocarbons from at least one separator; and (c) sending the hydrocarbon stream to an ionic liquid extractor containing a hydrocarbon feed-immiscible ionic liquid to remove metal compounds;

wherein the hydrocarbon feed-immiscible ionic liquid comprises at least one of trihexyl(tetradecyl)phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate;

and wherein greater than 40 wt % of the metal compounds are removed from said hydrocarbon stream.

2. The process of claim 1 wherein said upgrading reactor is selected from the group consisting of a slurry hydrocracking reactor, a vis-breaking reactor and a delayed coking reactor.

3. The process of claim 1 further comprising passing at least a portion of the hydrocarbon stream from said ionic liquid extractor to a reactor for further downstream processing.

4. The process of claim 1 further comprising washing at least a portion of the hydrocarbon stream from said ionic liquid extractor with water to produce a washed hydrocarbon feed stream and a spent water stream.

5. The process of claim 4 further comprising passing at least a portion of the washed hydrocarbon feed stream to a hydrocarbon conversion process.

6. The process of claim 1 further comprising contacting the hydrocarbon feed-immiscible ionic liquid effluent with a regeneration solvent and separating the hydrocarbon feed-immiscible ionic liquid effluent from the regeneration solvent to produce an extract stream comprising the metal compounds and a regenerated hydrocarbon feed-immiscible ionic liquid stream.

7. The process of claim 6 further comprising recycling at least a portion of the regenerated hydrocarbon feed-immiscible ionic liquid stream to the metal compound removal contacting step of claim 1(c).

8. The process of claim 6 wherein the regeneration solvent comprises a lighter hydrocarbon fraction relative to the hydrocarbon feed and the extract stream further comprises the lighter hydrocarbon.

9. The process of claim 6 wherein the regeneration solvent comprises water and the regenerated hydrocarbon feed-immiscible ionic liquid stream comprises water.

10. The process of claim 1 wherein up to 100 wt % of said metal compounds are removed from said hydrocarbon feed.

11. A process for removing metal compounds from a hydrocarbon feed produced by a primary upgrading process comprising:

(a) contacting the hydrocarbon feed comprising the metal compounds with a hydrocarbon feed-immiscible ionic liquid to produce a mixture comprising the hydrocarbon feed, and the hydrocarbon feed-immiscible ionic liquid;

(b) separating the mixture to produce a hydrocarbon feed effluent and a hydrocarbon feed-immiscible ionic liquid effluent, the hydrocarbon feed-immiscible ionic liquid effluent comprising the metal compounds;

(c) washing at least a portion of the hydrocarbon feed effluent with water to produce a washed hydrocarbon feed stream and a spent water stream;

(d) contacting the hydrocarbon feed-immiscible ionic liquid effluent with a regeneration solvent and separating the hydrocarbon feed-immiscible ionic liquid effluent from the regeneration solvent to produce an extract stream comprising the metal compounds and a regenerated hydrocarbon feed-immiscible ionic liquid stream; and (e) drying at least a portion of at least one of the hydrocarbon feed-immiscible ionic liquid effluent; the spent water stream, and the regenerated hydrocarbon feed-immiscible ionic liquid stream to produce a dried hydrocarbon feed-immiscible ionic liquid stream;

wherein the hydrocarbon feed-immiscible ionic liquid comprises at least one of trihexyl(tetradecyl)phosphonium chloride, trihexyl(tetradecyl)phosphonium bromide, tributyl(methyl)phosphonium bromide, tributyl (methyl)phosphonium chloride, tributyl(hexyl) phosphonium bromide, tributyl(hexyl)phosphonium chloride, tributyl(octyl)phosphonium bromide, tributyl (octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate; and wherein greater than 40 wt. % of the metal compounds are removed from said hydrocarbon stream.

12. The process of claim 11 wherein said primary upgrading process is selected from the group consisting of slurry hydrocracking, vis-breaking and delayed coking.

13. The process of claim 11 further comprising recycling at least a portion of at least one of the hydrocarbon feed-immiscible ionic liquid effluent; the spent water stream, the regenerated hydrocarbon feed-immiscible ionic liquid stream, and the dried hydrocarbon feed-immiscible ionic liquid stream to contaminant removal contacting step of claim 11(a).

14. The process of claim 11 wherein up to 100 wt % of said metal compounds are removed from said hydrocarbon feed.

* * * * *